US010226813B2

(12) United States Patent
Kim et al.

(10) Patent No.: US 10,226,813 B2
(45) Date of Patent: Mar. 12, 2019

(54) METHOD OF MANUFACTURING ALUMINUM-ZINC-BASED ALLOY SHEET USING TWIN-ROLL CASTING AND ALUMINUM-ZINC-BASED ALLOY SHEET MANUFACTURED THEREBY

(71) Applicant: KOREA INSTITUTE OF MACHINERY AND MATERIALS, Daejeon (KR)

(72) Inventors: Hyoung-Wook Kim, Changwon-si (KR); Yun-Soo Lee, Changwon-si (KR); Cha Yong Lim, Changwon-si (KR); Jae Hyung Cho, Changwon-si (KR)

(73) Assignee: Korea Institute of Machinery and Materials, Daejeon (KR)

( * ) Notice: Subject to any disclaimer, the term of this patent is extended or adjusted under 35 U.S.C. 154(b) by 924 days.

(21) Appl. No.: 14/055,788

(22) Filed: Oct. 16, 2013

(65) Prior Publication Data

US 2015/0064058 A1 Mar. 5, 2015

(30) Foreign Application Priority Data

Sep. 5, 2013 (KR) ..... 10-2013-0106431

(51) Int. Cl.
*B22D 11/00* (2006.01)
*B22D 11/06* (2006.01)
(Continued)

(52) U.S. Cl.
CPC ..... *B22D 11/0622* (2013.01); *B22D 11/003* (2013.01); *B22D 11/0682* (2013.01);
(Continued)

(58) Field of Classification Search
CPC ..... B22D 11/0622; B22D 11/003; B22D 11/0682
See application file for complete search history.

(56) References Cited

U.S. PATENT DOCUMENTS 4,951,736 A * 8/1990 Yukumoto ..... B22D 11/0651 164/138
6,620,265 B2 * 9/2003 Kawahara ..... B22D 11/0622 148/437
(Continued)

FOREIGN PATENT DOCUMENTS

JP 07-314098 12/1995
JP 2005-254329 9/2005
(Continued)

OTHER PUBLICATIONS

E. Rooy, Aluminum Alloy Ingot Casting and Continuous Processes, Casting, vol. 15, ASM Handbook, ASM International, 2008, p. 1001-1008.*

*Primary Examiner* — George Wyszomierski
*Assistant Examiner* — Janell C Morillo
(74) *Attorney, Agent, or Firm* — Leydig, Voit & Mayer, Ltd.

(57) ABSTRACT

Provided are a method of manufacturing an aluminum-zinc-based alloy sheet using twin-roll casting and an aluminum-zinc-based alloy sheet manufactured thereby. Specifically, a method of manufacturing an aluminum-zinc-based alloy sheet, including preparing a melt by melting elements corresponding to an aluminum alloy including 0.5 wt % to 10 wt % of zinc, inevitable impurities and aluminum as a balance (step 1); and twin-roll casting by introducing the melt prepared in step 1 between a pair of rotating cooling rolls (step 2), and an aluminum-zinc-based alloy sheet manufactured thereby are provided.

The present invention may manufacture an aluminum-zinc-based alloy sheet, in which twin-roll casting is known to be
(Continued)

difficult due to a wide solid-liquid coexistence region, by twin-roll casting by using cooling rolls having high thermal conductivity and controlling a reduction force by the rotational speed of the rolls.

7 Claims, 4 Drawing Sheets

(51) Int. Cl.
*C22C 21/10* (2006.01)
*C22C 21/08* (2006.01)
*C22C 9/00* (2006.01)

(52) U.S. Cl.
CPC ..... *C22C 21/08* (2013.01); *C22C 21/10* (2013.01); *C22C 9/00* (2013.01)

(56) References Cited

U.S. PATENT DOCUMENTS

2012/0055588 A1* 3/2012 Kamat ..... C22C 21/10 148/551
2016/0089860 A1* 3/2016 Kurosaki ..... C22C 21/02 428/654

FOREIGN PATENT DOCUMENTS

| | | | |
|---|---|---|---|
| JP | 2006-200017 | | 8/2006 |
| JP | 2006-200018 | | 8/2006 |
| JP | 2007-098407 | | 4/2007 |
| JP | 2007-100205 | | 4/2007 |
| JP | 2010-179363 | | 8/2010 |
| JP | 2011062708 | A * | 3/2011 |
| KR | 10-0861563 | | 10/2008 |
| WO | WO 2013/086628 | | 6/2013 |

* cited by examiner

EXAMPLE 1

EXAMPLE 2

EXAMPLE 3

METHOD OF MANUFACTURING ALUMINUM-ZINC-BASED ALLOY SHEET USING TWIN-ROLL CASTING AND ALUMINUM-ZINC-BASED ALLOY SHEET MANUFACTURED THEREBY

CROSS-REFERENCES TO RELATED APPLICATION

This patent application claims the benefit of priority from Korean Patent Application No. 10-2013-0106431, filed on Sep. 5, 2013, the contents of which are incorporated herein by reference.

BACKGROUND OF THE INVENTION

1. Field of the Invention

The present disclosure relates to a method of manufacturing an aluminum-zinc-based alloy sheet using twin-roll casting and an aluminum-zinc-based alloy sheet manufactured thereby.

2. Description of the Related Art

Recently, in line with the global trend for improving fuel efficiency through weight reductions in transportation equipment parts, the need for lightweight and high strength materials increases. Among these materials, the amount of aluminum (Al) alloys used has rapidly increased due to their excellent castability, processability, mechanical properties, endurance limit, and recyclability.

In particular, among the aluminum alloys, 7000 series aluminum alloys, in which zinc and magnesium are added as main alloying elements, have been mainly used as an aircraft material. However, applications of the 7000 series aluminum alloys as an automotive material and cases for electronic devices have been expanded due to their excellent mechanical properties.

Strength of the 7000 series aluminum alloys increases as the contents of additive elements, such as zinc, are increased. However, since the occurrence of casting defects may be facilitated due to the expansion of a solid-liquid coexistence region and various stages of processing must be undergone due to a decrease in processability, the price of a final material may be high in comparison to a typical steel material.

In order to address the above limitations, various research into decreasing manufacturing costs of the 7000 series aluminum alloys by using a simple manufacturing process has conducted, and one of the research areas is a strip casting method, in which a sheet may be directly produced from a melt. However, the strip casting method developed so far is limited to a technique of manufacturing a low-alloyed aluminum alloy, and a technique of manufacturing a high-alloyed aluminum alloy having excellent strength has not been secured.

An aluminum alloy sheet and a manufacturing method thereof were disclosed in Korean Patent No. 10-0933385 as a prior art related to the manufacturing of an aluminum alloy sheet. Specifically, the method of manufacturing an aluminum alloy sheet was disclosed, in which an aluminum alloy melt is introduced and casted between a pair of rotating twin rolls and thus, an aluminum alloy plate ingot that includes greater than 8 wt % to 14 wt % or less of magnesium (Mg), 1.0 wt % or less of iron (Fe), and 0.5 wt % or less of silicon (Si), and has a thickness ranging from 1 mm to 13 mm is obtained by twin-roll continuous casting. In a method of manufacturing an aluminum alloy thin sheet having a thickness of 0.5 mm to 3 mm by cold rolling of the ingot, casting is performed at an average cooling rate of 50° C./s or more until the center of the plate ingot is solidified after the melt is introduced between the twin rolls. Also, in a subsequent process of heating the plate ingot or the thin sheet to a temperature of 400° C. or more, an average heating rate is 5° C./s or more when a temperature of the center of the plate ingot or the thin sheet is in a range of 200° C. to 400° C., and in cooling the plate ingot or the thin sheet from the temperature greater than 200° C., cooling is performed at an average cooling rate of 5° C./s or more until the temperature reaches 200° C.

However, the aluminum alloy is an Al—Mg-based alloy, i.e., 5000 series aluminum alloys, and description, which is related to the 7000 series alloys having the highest strength among aluminum alloys, has not been disclosed in the prior patent.

Also, an aluminum alloy thick plate and a manufacturing method thereof were disclosed in Korean Patent No. 10-1251235. Specifically, the disclosed method of manufacturing an aluminum thick plate includes performing a melting process, in which an aluminum alloy melt is prepared by melting an aluminum alloy including 3.0 wt % to 9.0 wt % of zinc (Zn), 0.4 wt % to 4.0 wt % of Mg, one or more elements of 0.7 wt % or less of Si, 0.8 wt % or less of Fe, 3.0 wt % or less of copper (Cu), 0.8 wt % or less of manganese (Mn), 0.5 wt % or less of chromium (Cr), 0.1 wt % or less of titanium (Ti), and 0.25 wt % or less of zirconium (Zr), other inevitable impurities and Al as a balance; a dehydrogenation process of removing hydrogen gas from the aluminum alloy melt; a filtration process of removing inclusions from the dehydrogenated aluminum alloy melt; a casting process of manufacturing an ingot by casting the aluminum alloy melt having the inclusions removed therefrom; a hot rolling process of manufacturing a hot-rolled plate by hot rolling the ingot to a predetermined thickness; a slicing process of cutting the hot-rolled plate to a predetermined length in a rolling direction and a width; and a smoothing process of smoothing a surface of the sliced hot-rolled sheet, wherein a thickness of the surface of the hot-rolled plate removed in the smoothing process is in a range of 2 mm to 5 mm for one side.

The aluminum alloy thick plate manufactured according to the prior patent is an aluminum-zinc-based aluminum alloy. However, since the ingot is first manufactured and a process of rolling the ingot is then performed instead of twin-roll strip casting as in the present invention, it may not be economical.

Accordingly, during research into a method of manufacturing an aluminum-zinc-based alloy sheet by twin-roll casting, the present inventors developed a method of manufacturing a defect-free aluminum-zinc-based alloy sheet by using cooling rolls having excellent thermal conductivity and controlling a reduction force by a roll speed, thereby leading to completion of the present invention.

SUMMARY OF THE INVENTION

One object of the present invention is to provide a method of manufacturing an aluminum-zinc-based alloy sheet.

Another object of the present invention is to provide an aluminum-zinc-based alloy sheet manufactured according to the above method.

In order to achieve the object, the present invention provides a method of manufacturing an aluminum-zinc-based alloy sheet, including: preparing a melt by melting elements corresponding to an aluminum alloy composed of 0.5 wt % to 10 wt % of zinc, inevitable impurities and aluminum as a balance (step 1); and twin-roll casting by introducing the melt prepared in step 1 between a pair of rotating cooling rolls (step 2).

The present invention also provides an aluminum-zinc-based alloy sheet that is manufactured according to the above manufacturing method.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
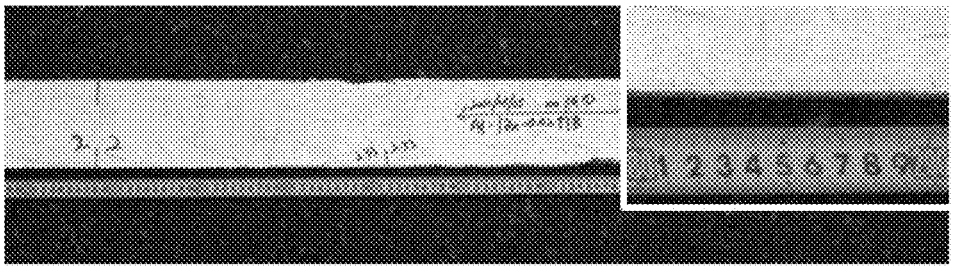
FIG. 1 is photographs illustrating aluminum-zinc-based alloy sheets manufactured in Examples 1 to 3.
Figure 1:
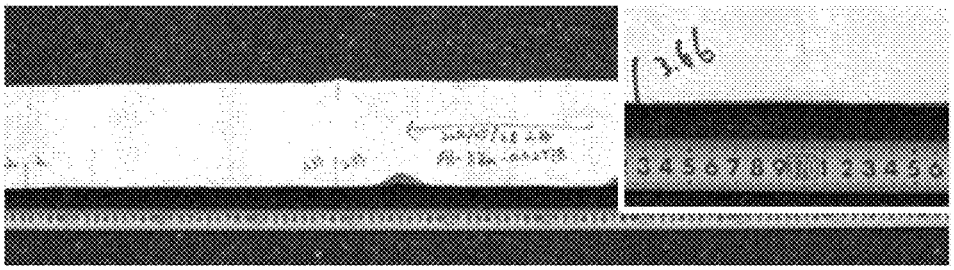
Figure 1:
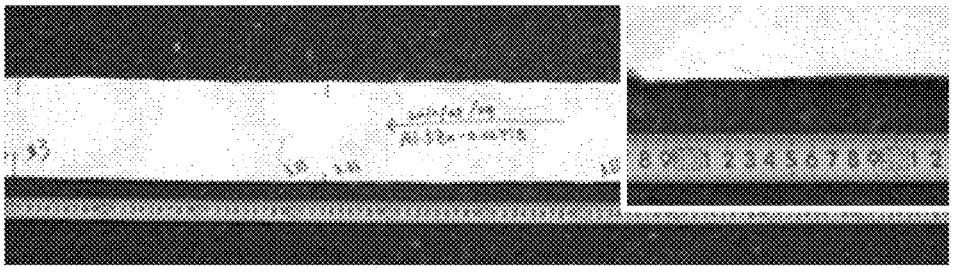

Features and advantages of the present invention will be more clearly understood by the following detailed description of the present preferred embodiments by reference to the accompanying drawings. It is first noted that terms or words used herein should be construed as meanings or concepts corresponding with the technical spirit of the present invention, based on the principle that the inventor can appropriately define the concepts of the terms to best describe his own invention. Also, it should be understood that detailed descriptions of well-known functions and structures related to the present invention will be omitted so as not to unnecessarily obscure the important point of the present invention.

The present invention provides a method of manufacturing an aluminum-zinc-based alloy sheet, the method including:

preparing a melt by melting elements corresponding to an aluminum alloy composed of 0.5 wt % to 10 wt % of zinc, inevitable impurities and aluminum as a balance (step 1); and twin-roll casting by introducing the melt prepared in step 1 between a pair of rotating cooling rolls (step 2).

Hereinafter, the method of manufacturing an aluminum-zinc-based alloy sheet according to the present invention will be described in detail for each step.

In the method of manufacturing an aluminum-zinc-based alloy sheet according to the present invention, step 1 is preparing a melt by melting elements corresponding to an aluminum alloy composed of 0.5 wt % to 10 wt % of zinc (Zn), inevitable impurities and aluminum (Al) as a balance.

The melt prepared in step 1 is a melt having a composition of an aluminum-zinc-based alloy, and since the aluminum-zinc-based alloy has high strength and is lightweight, the aluminum-zinc-based alloy may be used as an automotive material and cases for electronic devices as well as an aircraft material.

In this case, a content of zinc may be in a range of 0.5 wt % to 10 wt % during the manufacturing of the melt in step 1. For example, the content of zinc may be in a range of 0.5 wt % to 6 wt % in consideration of castability of the sheet and the occurrence of segregation.

In the case that zinc is included in the content of 0.5 wt % to 6 wt % in the melt of step 1, castability may be better and less segregation may occur.

However, in the case in which the aluminum-zinc-based alloy melt includes zinc in the content of less than 0.5 wt %, there is no effect of improving strength, and in the case that the aluminum-zinc-based alloy melt includes zinc in the content of greater than 10 wt %, castability may be poor due to a decrease in the fluidity of the melt, twin-roll casting may be difficult, and mechanical properties may decrease due to the segregation in the center of the manufactured alloy sheet.

The melt in step 1 may further include one or more metals of titanium (Ti), zirconium (Zr), and chromium (Cr) as a grain refining element.

The melt may include 0.005 wt % to 0.2 wt % of titanium.

Also, the titanium may be added as a grain refining agent including titanium. An aluminum master alloy including titanium, for example, Al-5Ti-1B (boron), may be used as the grain refining agent including titanium. However, the grain refining agent is not limited thereto.

In the case that less than 0.005 wt % of the titanium is added to the aluminum-zinc-based alloy melt, there is no effect of grain refinement, and in the case in which greater than 0.2 wt % of the titanium is included in the melt, ductility may decrease due to the formation of a coarse intermetallic compound.

The melt may include zirconium in an amount ranging from 0.01 wt % to 0.3 wt %.

The zirconium may refine grains by inhibiting recrystallization.

Also, the zirconium may be added as a grain refining agent including zirconium. An aluminum master alloy including zirconium may be used as the grain refining agent including zirconium. However, the grain refining agent is not limited thereto.

In the case that less than 0.01 wt % of the zirconium is added to the aluminum-zinc-based alloy melt, there is no effect of grain refinement, and in the case in which greater than 0.3 wt % of the zirconium is included in the melt, ductility may decrease due to the formation of a coarse intermetallic compound.

The melt may include chromium in an amount ranging from 0.01 wt % to 0.3 wt %.

The chromium may be added as a grain refining agent including chromium. An aluminum master alloy including chromium may be used as the grain refining agent including chromium. However, the grain refining agent is not limited thereto.

The chromium may refine grains by inhibiting recrystallization.

In the case that less than 0.01 wt % of the chromium is added to the aluminum-zinc-based alloy melt, there is no effect of grain refinement, and in the case in which greater than 0.3 wt % of the chromium is included in the melt, ductility may decrease due to the formation of a coarse intermetallic compound.

In the method of manufacturing an aluminum-zinc-based alloy sheet according to the present invention, step 2 is twin-roll casting by introducing the melt prepared in step 1 between a pair of rotating cooling rolls.

Typically, since an aluminum-zinc-based alloy may be lightweight and may simultaneously exhibit high strength, the aluminum-zinc-based alloy has been widely used as an aircraft material. However, since the manufacturing process thereof is complex, the price may be high. Also, it is known that production of the aluminum-zinc-based alloy by twin-roll casting may be impossible because the aluminum-zinc-based alloy has a wide solid-liquid coexistence region.

The manufacturing method of the present invention is for twin-roll casting of the aluminum-zinc-based alloy, in which it is known that the twin-roll casting may not be applied thereto as described above, and for this purpose, the twin-roll casting is performed by using cooling rolls having excellent thermal conductivity in step 2.

As described above, since the aluminum-zinc-based alloy has a considerably wide solid-liquid coexistence region, a cooling rate of the melt must be considerably high in order to cool the melt passing though the rolls in a short period of time. Thus, the cooling rolls having a high cooling rate are used in the casting of the aluminum-zinc-based aluminum alloy.

A copper (Cu) alloy roll or copper roll may be used as the cooling roll, and the copper alloy may be Cu—Cr or Cu—Be (beryllium). However, the cooling roll is not limited thereto, and any cooling roll having high thermal conductivity, which may solidify the melt in a short period of time, may be appropriately selected and used.

For example, in the case that the copper alloy roll (Cu—Cr) is used in the casting of the aluminum-zinc-based aluminum alloy, a sheet may be manufactured by the solidification of the melt in a short period of time due to the high thermal conductivity of the copper alloy roll.

In this case, the cooling roll may include a water cooling hole. Since the cooling of the melt may be further promoted when the cooling hole is included in the cooling roll, the aluminum-zinc-based alloy melt may be cooled faster during the manufacturing of the aluminum-zinc-based alloy sheet that requires a high cooling rate due to the wide solid-liquid coexistence region.

A gap between the cooling rolls in step 2 may be in a range of 2 mm to 10 mm.

In the case that the gap between the pair of cooling rolls is less than 2 mm, since a thickness of the manufactured sheet is low, a subsequent thermomechanical treatment process may be difficult to be performed. In the case in which the gap between the pair of cooling rolls is greater than 10 mm, since the subsequent thermomechanical treatment process must be sufficiently performed because the thickness of the sheet is high, advantages of the twin-roll casting for skipping a process may disappear.

A rotational speed of the cooling rolls in step 2 may be in a range of 2 m/min to 10 m/min.

In the case that the rotational speed of the cooling roll is less than 2 m/min, since the melt is solidified and the solidified melt then passes through the rolls due to the relatively low speed of the roll, a reduction force may increase, and thus, a lot of cracks may occur in the manufactured sheet. Also, in the case in which the rotational speed of the cooling roll is greater than 10 m/min, since the melt may flow down, a sheet may not be manufactured.

When the twin-roll casting of step 2 is performed, a reduction force applied to the melt from the cooling rolls may be in a range of 10 kg/mm to 100 kg/mm.

For example, when copper alloy rolls are used, casting of a sheet may not be performed or defects, such as casting marks, may be formed in the case that the reduction force is less than 10 kg/mm under the condition of using the copper alloy (Cu—Cr) rolls having a diameter of 300 mm. In the case in which the reduction force of the cooling roll is greater than 100 kg/mm, mechanical properties may be decreased due to the formation of cracks in the sheet.

However, the range of the reduction force is described by exemplifying the case where the copper alloy (Cu—Cr) rolls having a diameter of 300 mm are used, the range of the reduction force may be appropriately changed according to conditions (e.g., diameter and material of the roll, 700 series alloy composition, etc.) under which the twin-roll casting is performed.

Also, the present invention provides a method of manufacturing an aluminum-zinc-based alloy sheet, the method including:

preparing a melt by melting elements corresponding to an aluminum alloy composed of 0.5 wt % to 10 wt % of zinc, 0.5 wt % to 5 wt % of magnesium, inevitable impurities and aluminum as a balance (step 1);

twin-roll casting by introducing the melt prepared in step 1 between a pair of rotating cooling rolls (step 2).

Hereinafter, the method of manufacturing an aluminum-zinc-based alloy sheet according to the present invention will be described in detail for each step.

In the method of manufacturing an aluminum-zinc-based alloy sheet according to the present invention, step 1 is preparing a melt by melting elements corresponding to an aluminum alloy composed of 0.5 wt % to 10 wt % of zinc, 0.5 wt % to 5 wt % of magnesium, inevitable impurities and aluminum as a balance.

In this case, a content of zinc may be in a range of 0.5 wt % to 10 wt % during the manufacturing of the melt in step 1. For example, the content of zinc may be in a range of 0.5 wt % to 6 wt % in consideration of castability of the sheet and the occurrence of segregation.

Magnesium in step 1 may be included in an amount ranging from 0.5 wt % to 5 wt % in the melt.

In the case that magnesium is added to the aluminum-zinc-based alloy, strength and formability may be improved.

In the case that the aluminum-zinc-based alloy melt includes magnesium in the amount of less than 0.5 wt %, degrees of strength and formability improvements may be insignificant, and in the case in which the aluminum-zinc-based alloy melt includes magnesium in the amount of greater than 5 wt %, manufacturing of sound sheets may be difficult due to the formation of hot cracks during the twin-roll casting.

The melt in step 1 may further include one or more metals of titanium, zirconium, and chromium as a grain refining element, and aluminum maser alloys including the grain refining elements may be added to the melt as a grain refining agent.

For example, the melt may include 0.005 wt % to 0.2 wt % of titanium, the melt may include 0.01 wt % to 0.3 wt % of zirconium, and the melt may include 0.01 wt % to 0.3 wt % of chromium.

In the method of manufacturing an aluminum-zinc-based alloy sheet according to the present invention, step 2 is twin-roll casting by introducing the melt prepared in step 1 between a pair of rotating cooling rolls.

In step 2, the twin-roll casting is performed by using cooling rolls having high thermal conductivity, and a copper alloy roll or copper roll may be used as the cooling roll.

The copper alloy may be Cu—Cr or Cu—Be. However, the cooling roll is not limited thereto. Also, the copper alloy roll may include a water cooling hole that may promote to increase a cooling rate.

A gap between the cooling rolls in step 2 may be in a range of 2 mm to 10 mm, a rotational speed of the cooling rolls may be in a range of 2 m/min to 10 m/min, and a reduction force of the rolls may be in a range of 10 kg/mm to 100 kg/mm. However, the range of the reduction force is described by exemplifying the case where the copper alloy (Cu—Cr) rolls having a diameter of 300 mm are used, the range of the reduction force may be appropriately changed according to conditions (e.g., diameter and material of the roll, 700 series alloy composition, etc.) under which the twin-roll casting is performed.

Furthermore, the present invention provides a method of manufacturing an aluminum-zinc-based alloy sheet, the method including:

preparing a melt by melting elements corresponding to an aluminum alloy composed of 0.5 wt % to 10 wt % of zinc, 0.5 wt % to 5 wt % of magnesium, 0.05 wt % to 3 wt % of copper, inevitable impurities and aluminum as a balance (step 1);

twin-roll casting by introducing the melt prepared in step 1 between a pair of rotating cooling rolls (step 2).

Hereinafter, the method of manufacturing an aluminum-zinc-based alloy sheet according to the present invention will be described in detail for each step.

In the method of manufacturing an aluminum-zinc-based alloy sheet according to the present invention, step 1 is preparing a melt by melting elements corresponding to an aluminum alloy composed of 0.5 wt % to 10 wt % of zinc, 0.5 wt % to 5 wt % of magnesium, 0.05 wt % to 3 wt % of copper, inevitable impurities and aluminum as a balance.

In this case, a content of zinc may be in a range of 0.5 wt % to 10 wt % during the manufacturing of the melt in step 1. For example, the content of zinc may be in a range of 0.5 wt % to 6 wt % in consideration of castability of the sheet and the occurrence of segregation. Also, magnesium in step 1 may be included in an amount ranging from 0.5 wt % to 5 wt % in the melt.

Copper in step 1 may be included in an amount ranging from 0.05 wt % to 3 wt % in the melt.

Copper is an element that may differentiate an Al—Zn—Mg-based alloy and an Al—Zn—Cu—Mg-based alloy, wherein the realization of a high-strength aluminum alloy may be possible when the aluminum-zinc-based alloy includes copper, and the realization of medium-strength series aluminum alloys having improved weldability, extrusion processability, and corrosion resistance may be possible even in the case in which copper is not included.

In the case that the aluminum-zinc-based alloy melt includes copper in the amount of less than 0.05 wt %, an effect of improving strength and ductility may be low, and in the case in which the aluminum-zinc-based alloy melt includes copper in the amount of greater than 3 wt %, manufacturing of sound sheets may be difficult because cracks may be formed due to the segregation during the twin-roll casting.

The melt in step 1 may further include one or more metals of titanium, zirconium, and chromium as a grain refining element, and aluminum maser alloys including the grain refining elements may be added to the melt as a grain refining agent.

For example, the melt may include 0.005 wt % to 0.2 wt % of titanium, the melt may include 0.01 wt % to 0.3 wt % of zirconium, and the melt may include 0.01 wt % to 0.3 wt % of chromium.

In the method of manufacturing an aluminum-zinc-based alloy sheet according to the present invention, step 2 is twin-roll casting by introducing the melt prepared in step 1 between a pair of rotating cooling rolls.

In step 2, the twin-roll casting is performed by using cooling rolls having high thermal conductivity, and a copper alloy roll or copper roll may be used as the cooling roll. The copper alloy may be Cu—Cr or Cu—Be. However, the cooling roll is not limited thereto. Also, the copper alloy roll may include a water cooling hole that may promote to increase a cooling rate.

A gap between the cooling rolls in step 2 may be in a range of 2 mm to 10 mm, a rotational speed of the cooling rolls may be in a range of 2 m/min to 10 m/min, and a reduction force of the rolls may be in a range of 10 kg/mm to 100 kg/mm. However, the range of the reduction force is described by exemplifying the case where the copper alloy (Cu—Cr) rolls having a diameter of 300 mm are used, the range of the reduction force may be appropriately changed according to conditions (e.g., diameter and material of the roll, 700 series alloy composition, etc.) under which the twin-roll casting is performed.

Furthermore, the present invention provides an aluminum-zinc-based alloy sheet that is manufactured by the above manufacturing method and has a grain diameter of 5 μm to 40 μm.

Despite the fact that the aluminum-zinc-based alloy has advantageous characteristics of high strength as well as being lightweight, production of the aluminum-zinc-based alloy by twin-roll casting, which is a sheet casting method that is relatively inexpensive and requires a short period of time, was not possible. However, in the twin-roll casting of the aluminum-zinc-based alloy melt according to the present invention, the twin-roll casting of a defect-free aluminum-zinc-based alloy sheet may be successfully performed by using copper alloy (Cu—Cr) rolls and controlling a reduction force through the rotational speed of the roll.

The grain diameter of the aluminum-zinc-based alloy sheet manufactured by the above manufacturing method is small, ranging from 5 μm to 40 μm.

Also, since the casting defects of the sheet may decrease, mechanical properties thereof may be improved.

Furthermore, since the sheet may be manufactured by an inexpensive and simple process, the sheet may be provided for the use as an aircraft material, an automotive material, and cases for electronic devices at a lower cost than before.

Hereinafter, the present invention will be described in more detail according to examples. However, the following examples are provided for illustrative purposes only, and the scope of the present invention should not be limited thereto in any manner.

EXAMPLE 1

Step 1: an Al-15 wt % Zn master alloy was added to an aluminum melt and melted at a temperature of 740° C. to prepare an aluminum alloy (Al-1Zn) melt including 1 wt % of Zn. Then, the aluminum alloy melt was completely melted by adding Al-5Ti-1B as a grain refining agent in an amount of 0.4 wt % (0.02 wt % of Ti) with respect to aluminum. The aluminum alloy melt was degassed by introducing argon (Ar) gas thereinto for 10 minutes and stirring.

Step 2: an about 4 mm thick aluminum-zinc-based alloy sheet was manufactured by twin-roll casting the melt prepared in step 1 using Cu—Cr upper/lower rolls having a diameter of 300 mm.

In this time, the conditions under which the twin-roll casting was performed are as follows.

A distance from the center of the roll to a tip of a ceramic nozzle was 35 mm, and the Cu—Cr upper/lower rolls were preheated to a temperature of 100° C. for removing moisture. The ceramic nozzle in a tundish was installed for preventing a decrease in the temperature of the melt.

Cooling water flowed at a speed of 80 L/min in water cooling holes of the rolls, and a roll speed was maintained at 5.652 m/min to 6.133 m/min in order to maintain a reduction force of about 40 kg/mm to about 55 kg/mm.

The melt heated at 680° C. was introduced into the preheated tundish composed of a 150 mm wide ceramic board.

EXAMPLE 2

An aluminum-zinc-based alloy sheet was manufactured in the same manner as Example 1 except that an aluminum alloy melt in step 1 of Example 1 included 3 wt % of zinc.

EXAMPLE 3

An aluminum-zinc-based alloy sheet was manufactured in the same manner as Example 1 except that an aluminum alloy melt in step 1 of Example 1 included 5 wt % of zinc.

EXAMPLE 4

An aluminum-zinc-based alloy sheet was manufactured in the same manner as Example 1 except that a 7075 alloy ingot was melted at 740° C. in step 1 of Example 1.

COMPARATIVE EXAMPLE 1

An aluminum-zinc-based alloy sheet was manufactured in the same manner as Example 4 except that a roll speed was maintained at 10.5 m/min to 11 m/min in order to maintain a reduction force of about 1 kg/mm to about 5 kg/mm in step 2 of Example 4.

COMPARATIVE EXAMPLE 2

An aluminum-zinc-based alloy sheet was manufactured in the same manner as Example 4 except that a roll speed was maintained at 1 m/min to 1.5 m/min in order to maintain a reduction force of about 120 kg/mm to about 140 kg/mm in step 2 of Example 4.

COMPARATIVE EXAMPLE 3

An aluminum-zinc-based alloy sheet was manufactured in the same manner as Example 4 except that steel rolls were used in step 2 of Example 4.

EXPERIMENTAL EXAMPLE 1

Figure 3:
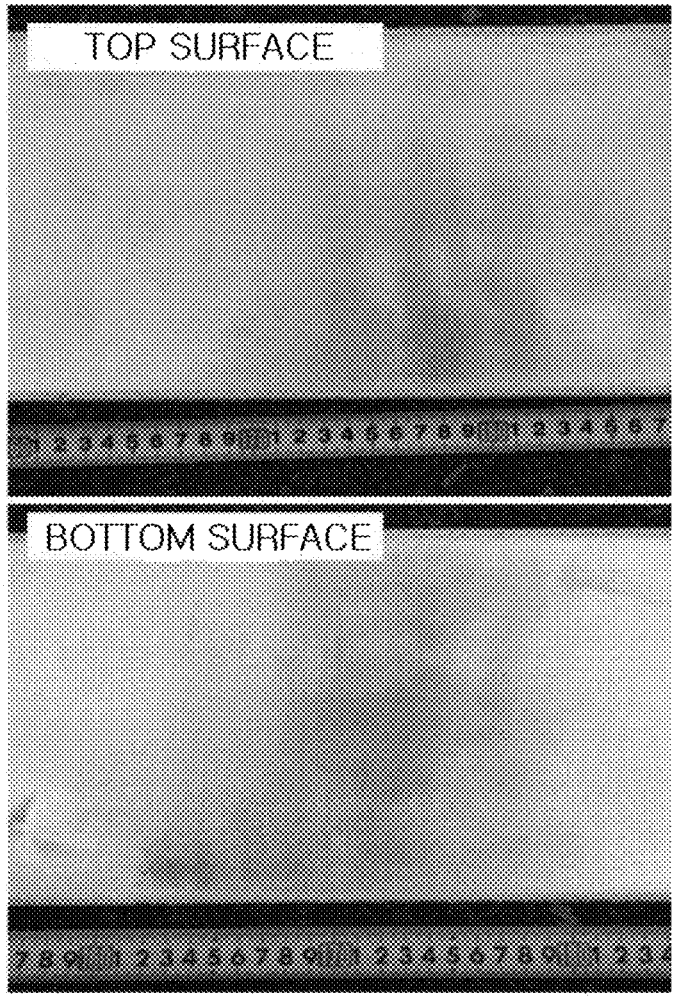
FIG. 3 is photographs illustrating an aluminum-zinc-based alloy sheet manufactured in Example 4.

Photographs showing the appearances of the aluminum-zinc-based alloy sheets manufactured in Examples 1 to 4 are illustrated in FIGS. 1 and 3.

As illustrated in FIG. 1, it may be understood that the aluminum-zinc-based alloy sheets manufactured in Examples 1 to 3 may be manufactured as a defect-free sound sheet, and edges of the sheets were also smooth without bending.

Also, as illustrated in FIG. 3, with respect to the aluminum-zinc-based alloy sheet manufactured in Example 4, a sound sheet having almost no defects formed on the top and bottom thereof may be manufactured.

Thus, it may be understood that sheets may be produced by applying a twin-roll casting process, which has only been applied to typical low-alloyed aluminum alloys, to aluminum-zinc-based alloys, and as a result, aluminum-zinc-based alloy sheets may be more economically manufactured.

EXPERIMENTAL EXAMPLE 2

Figure 4:
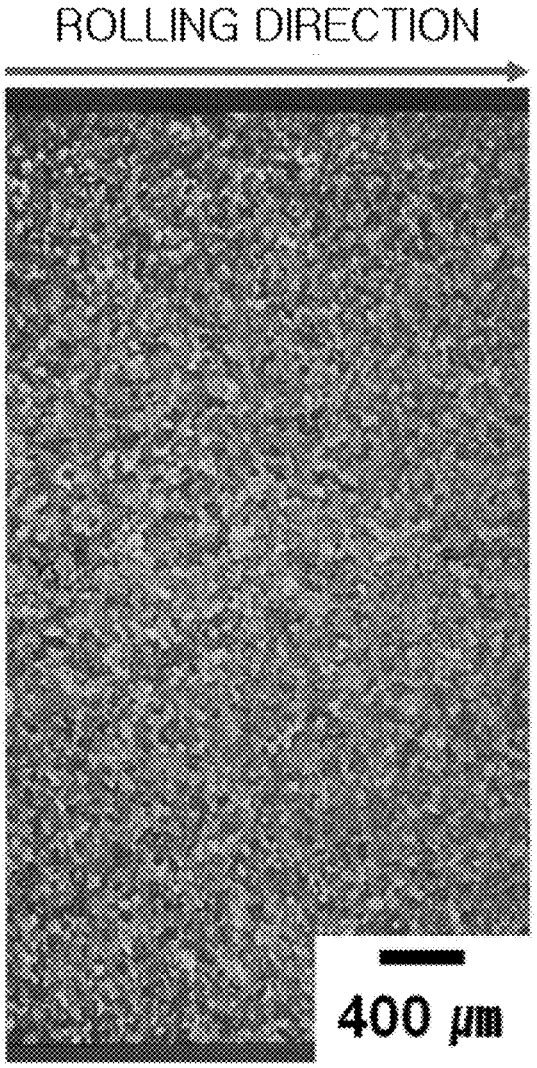
FIG. 4 is a photograph illustrating a microstructure of the aluminum-zinc-based alloy sheet manufactured in Example 4.

In order to investigate a microstructure of the aluminum-zinc-based alloy sheet manufactured in Example 4, a side (surface formed by a rolling direction and a direction perpendicular to a sheet surface) of the aluminum-zinc-based alloy sheet was observed with an optical microscope, and the result thereof is presented in FIG. 4.

As illustrated in FIG. 4, the aluminum-zinc-based alloy sheet was composed of fine grains having a diameter of 5 μm to 40 μm, which are distributed from the surface to the center thereof.

Thus, it may be confirmed that the aluminum-zinc-based alloy may be casted into a sheet having fine grains by the twin-roll casting.

EXPERIMENTAL EXAMPLE 3

Figure 2:
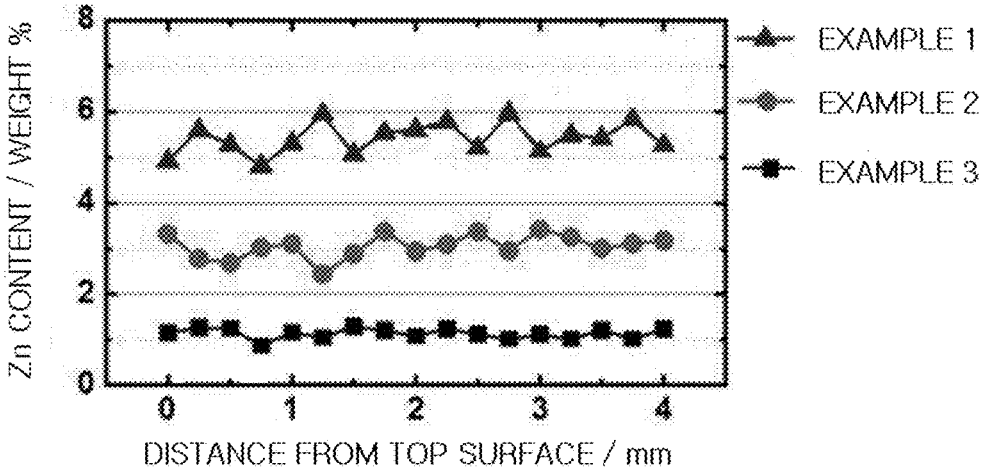
FIG. 2 is graphs illustrating compositions of the aluminum-zinc-based alloy sheets manufactured in Examples 1 to 3.

In order to analyze a zinc content in a thickness direction of the aluminum-zinc-based alloy sheets manufactured in Examples 1 to 3, the aluminum-zinc-based alloy sheets were investigated by scanning electron microscope (SEM)-energy dispersive spectroscopy (EDS) (X-ray spectroscopy), and the results thereof are presented in FIG. 2.

As illustrated in FIG. 2, the zinc contents according to thicknesses of the manufactured aluminum-zinc-based alloy sheets were uniform, in which the zinc contents of Examples 1, 2 and 3 were respectively in a range of about 0.8 wt % to about 1.4 wt %, about 2.3 wt % to about 5.6 wt %, and about 4.8 to about 6.2 wt %.

Thus, it may be confirmed that when the aluminum-zinc-based alloy sheets were manufactured by the twin-roll casting, relatively uniform composition distributions were obtained from the surface to the center thereof, and sound sheets with no segregation may be manufactured.

EXPERIMENTAL EXAMPLE 4

States of the aluminum-zinc-based alloy sheets manufactured in Example 4 and Comparative Example 3 are listed in Table 1.

TABLE 1

| | Roll material | Sheet appearance |
|---|---|---|
| Example 4 | Copper alloy (Cu—Cr) roll | Possible to manufacture a sound sheet |
| Comparative Example 3 | Steel roll | Impossible to manufacture a sheet because the melt was not solidified and flowed down. |

As listed in Table 1, it may be confirmed that in the case that the copper alloy rolls were used as in Example 4, a sound sheet may be manufactured. However, in the case in which the steel rolls were used as in Comparative Example 3, it may be confirmed that the manufacturing of a sheet may be impossible because the melt was not solidified and flowed down.

Thus, it may be understood that since the aluminum-zinc-based alloy had a wide solid-liquid coexistence region, a sound sheet may be manufactured when the copper alloy rolls, which may rapidly cool the melt, as in Example 4 were used. In contrast, in the case that the steel rolls having lower thermal conductivity than the copper alloy rolls were used as in Example 3, it may be understood that the manufacturing of a sheet may be impossible because the aluminum-zinc-based alloy melt was not solidified and flowed down. Also, it may be understood that since the casting must be slowly performed according to a slow solidification rate in order to manufacture a sheet using the steel rolls, processing time may be relatively long.

EXPERIMENTAL EXAMPLE 5

States of the aluminum-zinc-based alloy sheets manufactured in Example 4 and Comparative Examples 1 and 2 are listed in Table 2.

TABLE 2

| | Roll speed | Reduction force | Sheet appearance |
|---|---|---|---|
| Example 4 | 5.652 to 6.123 m/min | 40 to 55 kg/mm | Possible to manufacture a sound sheet |
| Comparative Example 1 | 10.5 to 11.0 m/min | 1 to 5 kg/mm | No casting of a sheet |
| Comparative Example 2 | 1.0 to 1.5 m/min | 120 to 140 kg/mm | Decrease in Mechanical properties due to the formation of many cracks in the sheet |

As illustrated in Table 2 and FIG. 1, in the case that the reduction force was in a range of 40 kg/mm to 55 kg/mm and the roll speed was in a range of 5.652 m/min to 6.123 m/min as in Example 4, a sound sheet may be manufactured. However, in the case in which the reduction force was in a range of 1 kg/mm to 5 kg/mm and the roll speed was in a range of 10.5 m/min to 11 m/min, or the reduction force was in a range of 120 kg/mm to 140 kg/mm and the roll speed was in a range of 1 m/min to 1.5 m/min as in Example 1 or 2, a sheet may not be casted, or mechanical properties may decrease due to the formation of a lot of cracks in the sheet.

Thus, it may be understood that a sound sheet may be manufactured under the appropriate reduction force and roll speed as in Example 4, and it may also be understood that a sheet may not be casted or the manufacturing of a sound sheet may be impossible when the reduction force was excessively low or high.

A method of manufacturing an aluminum-zinc-based alloy sheet according to the present invention may manufacture an aluminum-zinc-based alloy sheet, in which twin-roll casting is known to be difficult due to a wide solid-liquid coexistence region, by twin-roll casting by using cooling rolls having high thermal conductivity and controlling a reduction force by the rotational speed of the rolls. Also, defects, such as cracks and casting marks, which cause a decrease in physical properties of the manufactured sheet, may not occur.

Furthermore, in the case that an aluminum-zinc-based alloy sheet is manufactured according to the above manufacturing method, the aluminum-zinc-based alloy sheet may be provided at a lower cost than before due to a simple manufacturing process.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of manufacturing an aluminum-zinc-based alloy sheet, the method comprising:

preparing a melt by melting elements corresponding to an aluminum alloy including 1 wt % to 6 wt % of zinc, 0.5 wt % to 5 wt % of magnesium and 0.05 wt % to 3 wt % of copper, inevitable impurities and aluminum as a balance (step 1); and twin-roll casting by introducing the melt prepared in step 1 between a pair of rotating cooling rolls (step 2), wherein the twin-roll casting in step 2 is performed under a condition of a reduction force of 10 kg/mm to 100 kg/mm, wherein the cooling roll of step 2 is a copper alloy roll or a copper roll, and wherein a gap is present between the cooling rolls of step 2 in a range of 2 mm to 10 mm.

2. The method as set forth in claim 1, wherein the copper alloy is copper (Cu)-chromium (Cr) or Cu-beryllium (Be).

3. The method as set forth in claim 1, wherein the melt of step 1 further comprises 0.005 wt % to 0.2 wt % of titanium.

4. The method as set forth in claim 1, wherein the melt of step 1 further comprises 0.01 wt % to 0.3 wt % of zirconium.

5. The method as set forth in claim 1, wherein the melt of step 1 further comprises 0.01 wt % to 0.3 wt % of chromium.

6. The method as set forth in claim 1, wherein the cooling rolls of step 2 comprise a water cooling hole.

7. The method as set forth in claim 1, wherein the twin-roll casting in step 2 is performed under a condition of a reduction force of 40 kg/mm to 55 kg/mm.

* * * * *